United States Patent [19]

Kinberg

[11] Patent Number: 4,801,266

[45] Date of Patent: Jan. 31, 1989

[54] IRRIDESCENT DRAWING OR SKETCHING DEVICE

[76] Inventor: Benjamin Kinberg, 425 Riverside Dr., New York, N.Y. 10025

[21] Appl. No.: 148,342

[22] Filed: Jan. 25, 1988

[51] Int. Cl.[4] ..... B43L 1/12; B43L 13/00; B44F 1/14

[52] U.S. Cl. ..... 434/85; 33/18.1; 428/46; 434/410

[58] Field of Search ..... 434/85, 81, 410; 428/46; 33/18.1

[56] References Cited

U.S. PATENT DOCUMENTS

| | | | |
|---|---|---|---|
| 3,055,113 | 9/1962 | Grandjean | 33/18.1 |
| 3,760,505 | 9/1973 | Clark | 33/18.1 |
| 3,761,343 | 9/1973 | Kinberg | 428/46 |
| 4,011,665 | 3/1977 | Port | 434/410 |
| 4,369,579 | 1/1983 | Mizoule | 33/18.1 |
| 4,669,984 | 6/1987 | Jones et al. | 434/410 |

FOREIGN PATENT DOCUMENTS

| | | | |
|---|---|---|---|
| 2148197 | 5/1985 | United Kingdom | 33/18.1 |

*Primary Examiner*—William H. Grieb
*Attorney, Agent, or Firm*—Arthur T. Fattibene

[57] ABSTRACT

An irridescent or luminescent drawing or sketching device that has a housing having a window therein, in which there is disposed a generally transparent imaging plate having an irridescent dye and disposed above an opaque pliable plastic sheet. Application of pressure will cause the opaque sheet to adhere to the imaging sheet at the points of applied pressure, causing an irridescent or luminescent image to appear at the imaging surface. Pressure is applied by a courser which is confined within intersecting slots of a pair of crossing courser arms whereby the movement of the individual courser arms along an X and Y axis causes the courser to translate accordingly. Included is an eraser disposed between the opaque sheet and imaging sheet to effect separation thereof to erase any image formed on the imaging sheet.

4 Claims, 4 Drawing Sheets

IRRIDESCENT DRAWING OR SKETCHING DEVICE

This invention is directed to an irridescent or luminescent sketching or drawing device.

RELATED INVENTIONS

This invention is a further advanced version of an irridescent or luminescent display device which was disclosed in a prior co-invented U.S. Pat. No. 3,761,343 granted Sept. 25, 1973 for Means For Providing A Semi-Permanent Irridescent Display.

PRIOR ART

Prior efforts have been known relating to irridescent or luminescent drawing or sketching type devices as evidenced in said U.S. Pat. No. 3,761,343 and in a much later U.S. Pat. No. 4,011,665 granted Mar. 15, 1977. The devices disclosed in these patents comprised essentially similar devices that included a "pad-like" structure made up of a pair of overlying sheets, one of which was rendered transluscent or transparent having dispersed therein an irridescent, luminescent or fluorescent dye and the other being a smooth, pliable, opaque plastic sheet, one in which the two sheets were disposed to interface relationship with one another. The arrangement was such that an irridescent or luminescent image was formed on the transluscent sheet by the application of pressure with a hand held stylus on one of the sheets.

Also known was a tracing or sketching device as disclosed in U.S. Pat. No. 3,760,505 granted Sept. 25, 1973, which comprised a transparent glass plate coated on one side thereof with a finely ground metallic powder to render the glass plate opaque in combination with a stylus which was connected to a pulley system by which the stylus was actuated in an X and Y direction by the interaction of a pair of dials. While such drawing and sketching devices are known, each were directed to separate and distinct use or applications due to their respective inherent structures.

OBJECTS

An object of this invention is to provide a relatively simple and attractive drawing device for displaying an irridescent or luminescent image by the coordination of a simplified actuating mechanism in an X and Y direction.

Another object of this invention is to provide for an irridescent or luminescent drawing device that can be readily erased for repeated use.

Another object is to provide a readily simple and positive acting luminescent drawing device that is relatively simple and inexpensive to make.

Another object is to provide for a luminescent or irridescent drawing or sketching device that is challenging and amusing to operate.

SUMMARY OF THE INVENTION

This invention is directed to an irridescent or luminescent drawing or sketching device which includes a housing having a window opening disposed therein. Positioned within the window opening is an imaging surface which is generally a transparent plate having dispersed therethrough an irridescent dye. Interfaced with the imaging surface and disposed immediately therebelow is an opaque pliable plastic sheet which, upon the application of pressure thereon, will cause the opaque sheet to adhere to the imaging sheet along the pressure or contact points to cause an irridescent or luminescent image to appear on the imaging surface. In accordance with this invention, the pressure is applied to the opaque sheet by means of a courser which is confined within intersecting slots of a pair of crossing courser arms whereby the movement of the respective courser arms along the X and Y axis of the imaging plate will cause the courser to translate along the surface of the opaque sheet to form an irridescent image to appear along the points of contact. The arrangement is such that the courser arms can be independently or simultaneously moved to effect a corresponding movement of the courser. By co-ordinating the movement of the courser arms along their respective X and Y axis, a desired image can be formed which is rendered irridescent.

Included in the arrangement is an eraser which comprises a handle disposed above the imaging plate to which there is connected a strand or filament arranged to be disposed between the imaging plate and the opaque sheet of material. By translating the handle of the eraser across the surface of the imaging plate causes the strand or filament to separate the opaque sheet from the imaging plate at the point of contact therebetween and thereby effectively erasing the image.

FEATURES

A feature of this invention resides in the provision of a sketching or drawing device which produces an irridescent or luminescent image by coordinating the movement of a courser thereon.

Another feature of the invention resides in the provision of a relatively simple and positive acting courser activating arrangement for controlling the courser in a manner to form a desired irridescent image.

Another feature resides in a simple erasing mechanism for effectively erasing a formed image.

Another feature resides in a readily simple and inexpensive drawing or sketching device which is amusing and challenging to operate.

Another feature of this invention resides in the provision that the sketching device can be fabricated in the form of a toy which is amusing and interesting to children.

Another feature of this invention resides in the provision of a sketching device constructed so as to provide more play value over the prior known irridescent type drawing devices such as disclosed in U.S. Pat. Nos. 3,761,343 and 4,011,665.

Other features and advantages will become more readily apparent when considered in view of the specification and drawings in which.

DETAIL DESCRIPTION

Figures 1, 1A:
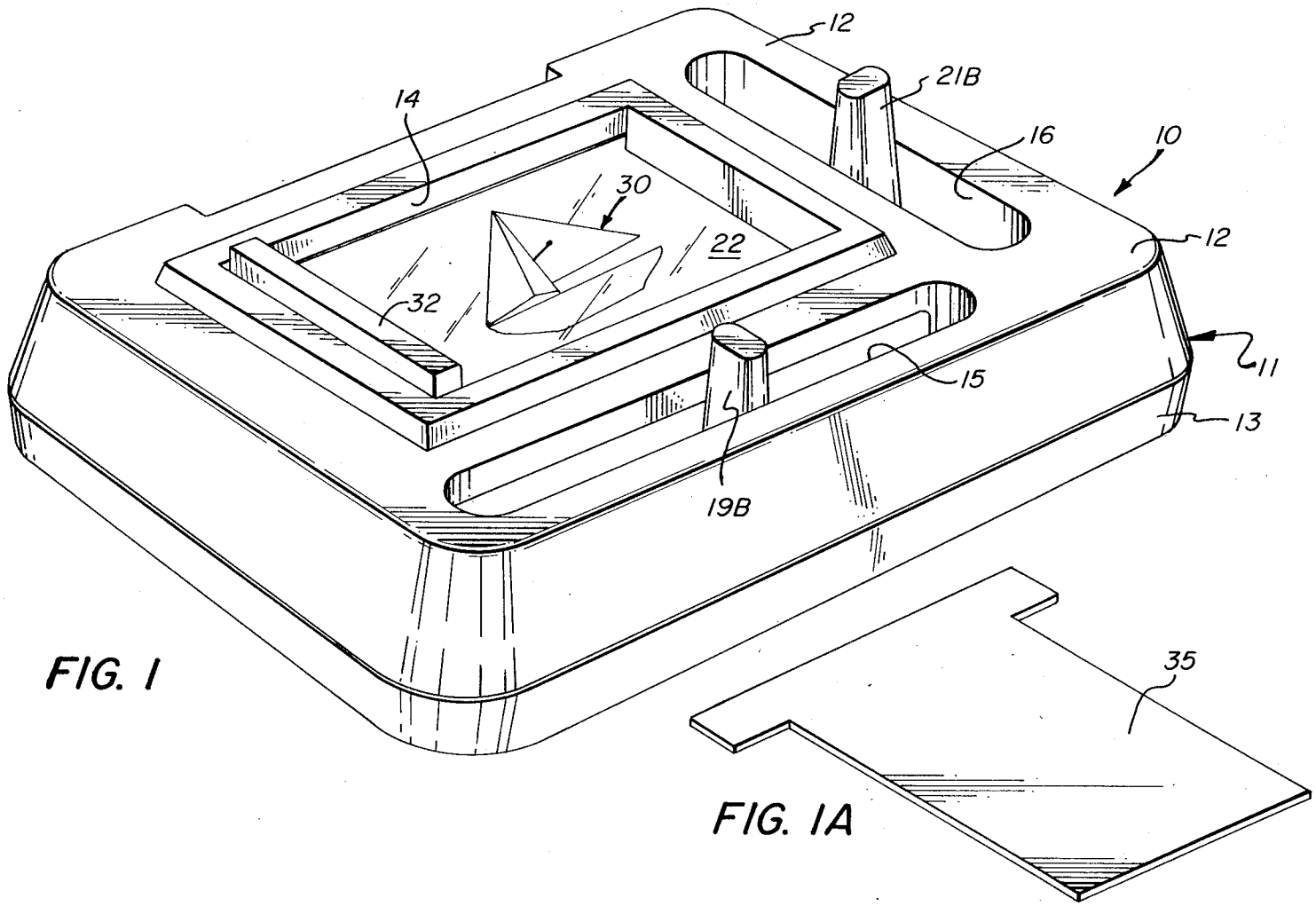
FIG. 1 is a perspective view of an embodiment of the present invention.
FIG. 1A is a plan view of a separating sheet for storing and packing purposes.

Referring to the drawings, there is shown in FIG. 1 a sketching or drawing device 10 embodying the present invention. The illustrated embodiment is in the form for use as a toy for young children recommended for children 4 years and older. However, it will be understood that the invention may have other uses, ie.g., in advertising or as a display device and such.

Figure 5:
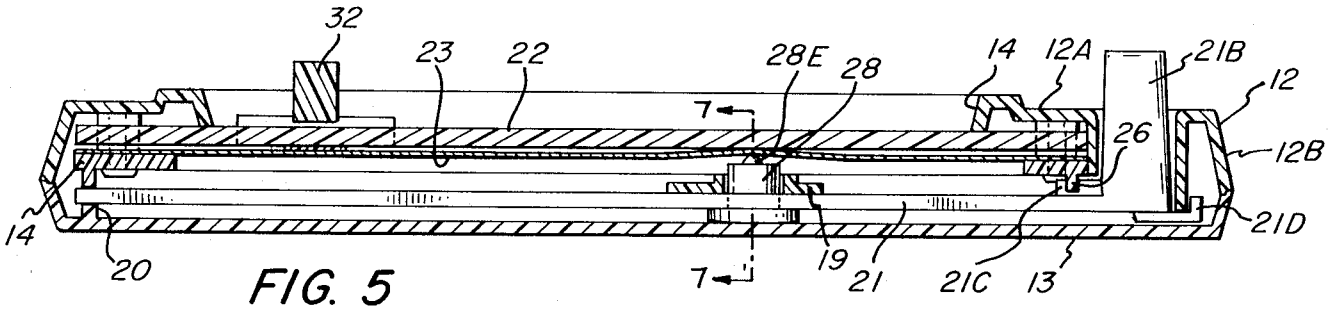
FIG. 5 is a sectional view taken on line 5—5 of FIG. 4.
Figure 6:
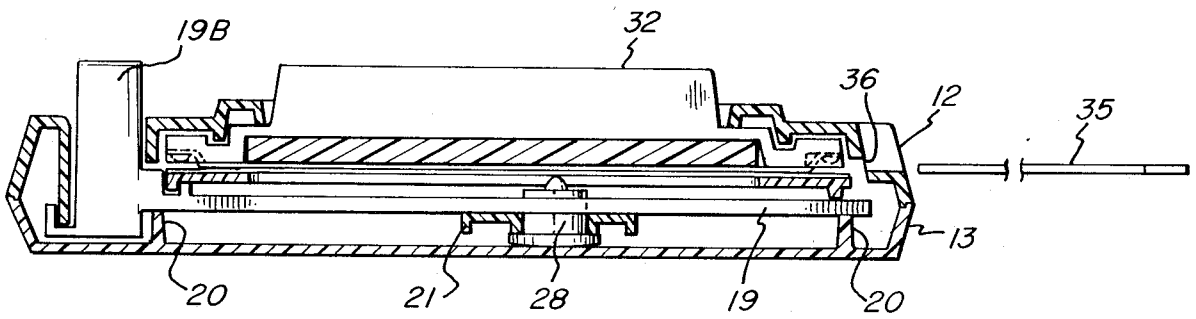
FIG. 6 is a sectional view taken on line 6—6 of FIG. 4.

The sketching device 10 comprises a housing 11 which is essentially made up of a complementary upper member 12 and a lower base member 13, which is suitably connected as seen in FIGS. 5 and 6. The respective housing members 12 and 13 comprise molded parts. As seen, the upper member is formed with an upper surface 12A circumscribed by a depending skirt or wall 12B. Formed in the upper surface 12A is a window opening 14 which defines the drawing or sketching area. Also formed in the upper surface 12A are a pair of elongated slotted openings 15 and 16 disposed at right angles along the adjacent edges of the upper member 12.

The base member 13 comprises a molded part defining a bottom wall 13A circumscribed by an upwardly extending ridge or rim 13B. The corners of the base member are provided with bases 17 for receiving screw fasteners by which the upper and lower base members 12 and 13 of the housing 11 are secured together. Projecting upwardly from the bottom wall 13A of the base member 13 are a pair of spaced apart rails 18—18 extending longitudinally to define a support for the X axis courser arm 19, as will be hereinafter described. Disposed between the rails 18, 18 at the respective ends there is a second pair of rails 20—20 which are slightly lower than rails 18—18 for supporting the Y axis courser arm 21, as will be hereinafter described.

Disposed within the window opening is an imaging plate 22. The imaging plate 22 may comprise a rigid or flexible transparent material such as plexiglass, acrylic plastic or glass or other suitable plastic material that has an irridescent dye dispersed throughout the plate. In the illustrated embodiment, a rigid plexiglass type material defines the imaging surface 22. Disposed immediately below the imaging surface 22 is a sheet of opaque material 23 which is preferably white. The opaque material 23 may be formed of a suitable, smooth white flexible plastic material, e.g., vinyl type plastic material. The vinyl sheet is provided with a smooth surface arranged to interface with the undersurface of the imaging plate 22. The arrangement is such that when a pressure is applied against the vinyl sheet 23, such pressure will cause a corresponding intimate contact at the interface between the imaging sheet 22 and the vinyl sheet 23, causing an irridescent or luminescent display to appear on the imaging plate 22.

Figure 3:
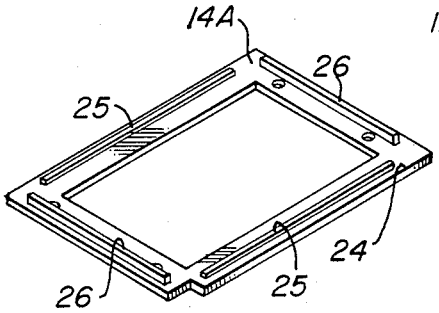
FIG. 3 is a perspective bottom view of the inner frame member.
Figure 2:
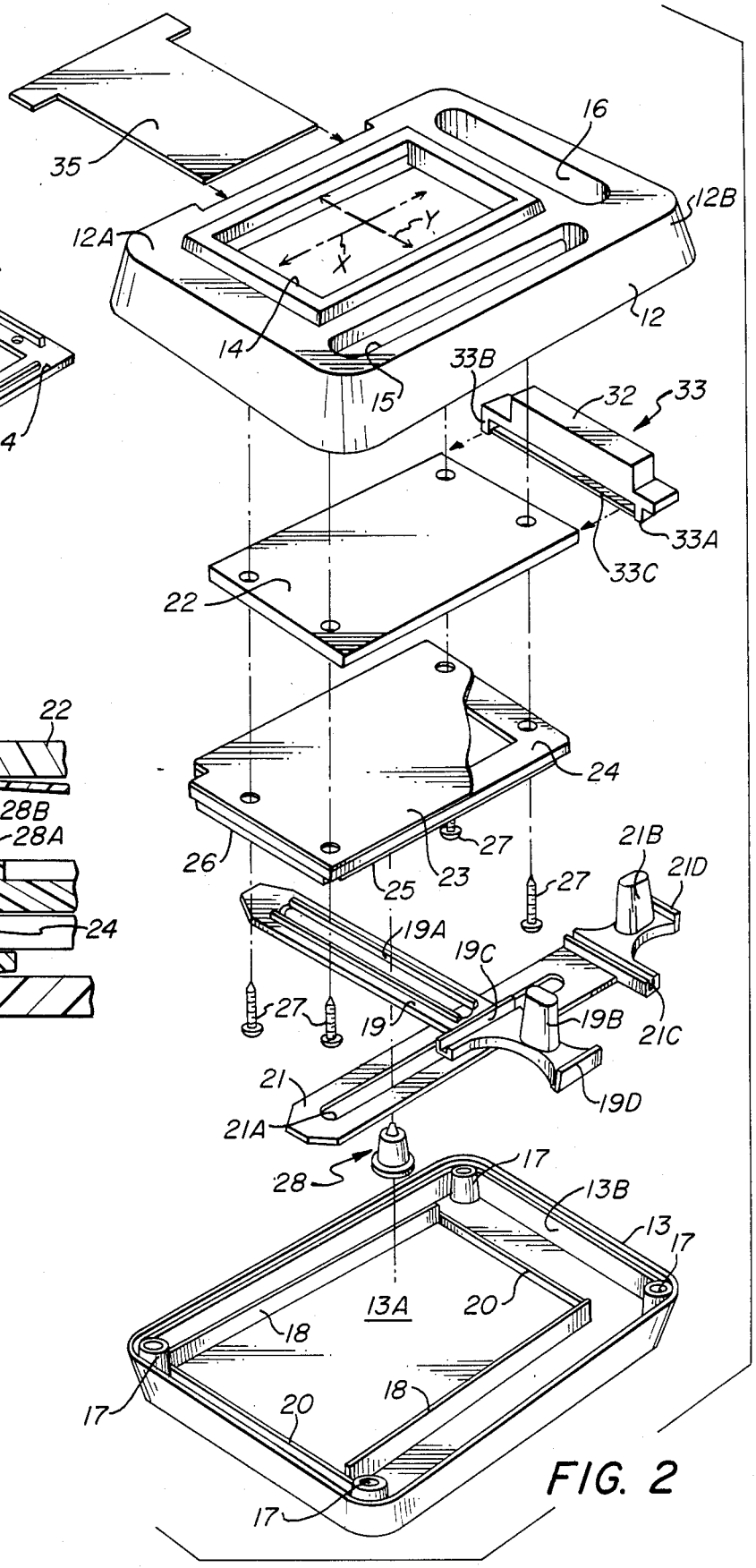
FIG. 2 is an exploded perspective view of the essential component parts of the illustrated embodiment of FIG. 1.
Figure 4:
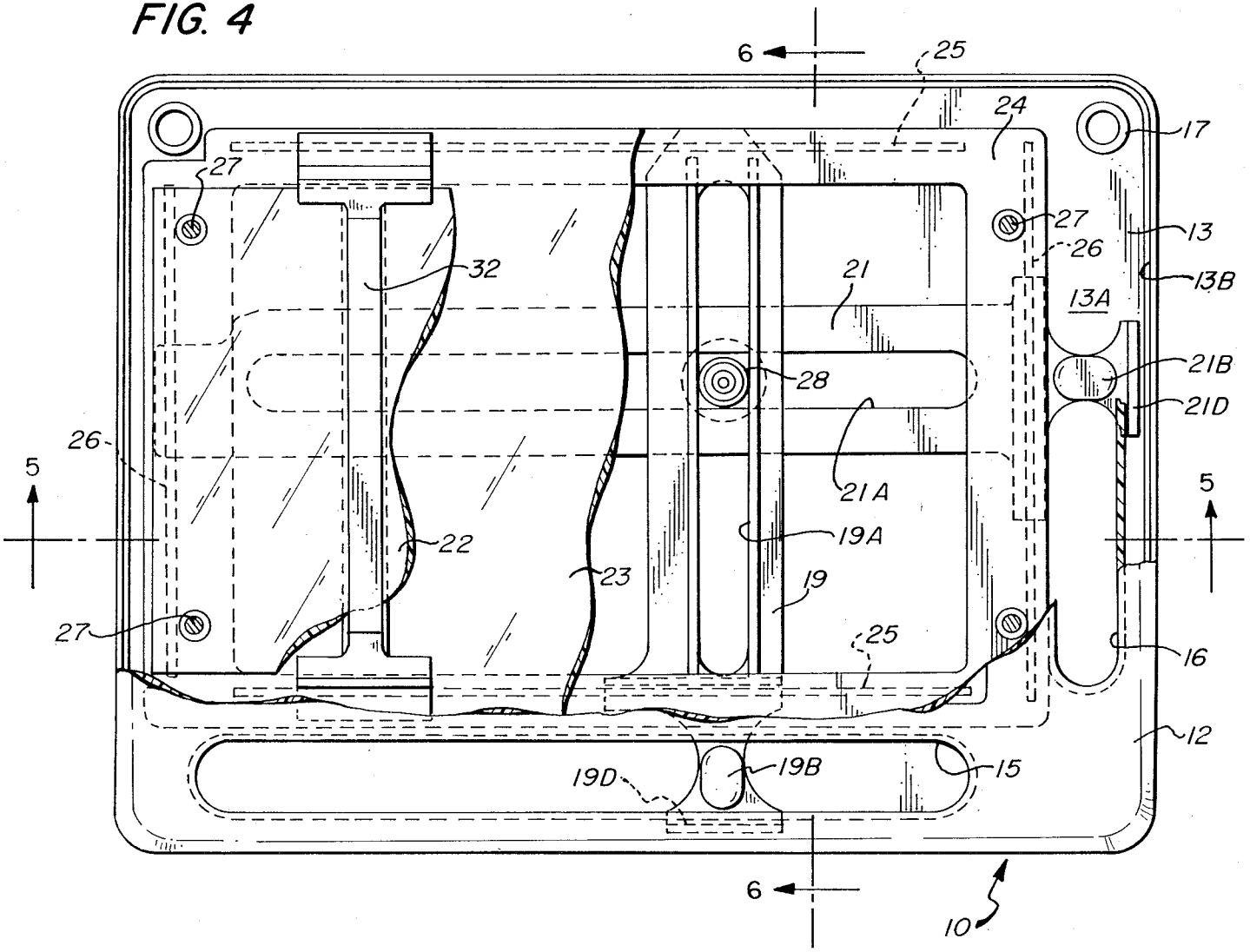
FIG. 4 is a plan view of the embodiment of FIG. 1 having parts broken away.

In accordance with this invention, the imaging plate 22 and the opaque sheet 23 are maintained in position relative to the upper housing member 12 by means of an inner frame 24. As shown in FIGS. 2 and 3, the inner frame 24 comprises a generally rectangularly shaped ring corresponding substantially to the size of the window opening 14. The lower surface 14A of the inner frame 24 is provided with depending rails 25 and 26 extending along the longitudinal and lateral edges thereof. Fasteners, such as screws 2, secure the inner frame 24 and the superposed opaque sheet 23 and imaging plate 22 to the upper housing member 12 wherein the imaging plate is disposed within the area of the window opening 14. In the assembled position, the rails 25 and 26 define a guide rail for the courser arms as will be hereinafter described.

In accordance with this invention, a pair of courser arms 19 and 21 are disposed normal to one another and moveably contained within the housing of traversing a course means 28 against the undersurface of the opaque sheet as will be described. In the illustrated embodiment, the courser arm 19 extends across the width of the imaging plate and is arranged to move back and forth across the longitudinal length of the imaging plate or along the X axis thereof. Courser arm 21 extends along the longitudinal axis or length of the imaging window 14 and it is arranged to shift or move along the width or the Y axis of the imaging window. In the illustrated embodiment, the respective courser arms are essentially similar in construction, except that courser arm 21 is slightly longer than courser arm 19 due to the rectangular shape of the imaging plate. Courser arm 19 is provided with an elongated slot 19A, which arm is provided with an operating knob 19B arranged to project upwardly through slot 15 formed in the upper housing member 12. The courser arm 19 is also provided with a groove 19C which in the assembled position is arranged to receive the guide rail 25 of the inner frame 24. In the assembled position, the courser arm 19 slides along the top of rails 18 formed on the base member 13. Extending laterally of the operating knob 19B, there is provided a tail 19D arranged to slide along the rim or edge 13B of the base member 13.

Courser arm 21 is similarly constructed. It has an elongated slot 21A, an operating knob 21B, a guide groove 21C and a tail 21D, similar to that of courser arm 19. In the assembly, the courser arm 21 extends along the length of the imaging window 14 or plate 22 and arranged to shift laterally along the Y axis of the imaging plate 22. In the illustrated embodiment, the courser arm slides on the lower rails 20—20 of the base member 13, with the operating knob 21B extending through opening or slot 16 of the upper housing member 12. Rail 26 is received within groove 21C of the courser arm 21 so as to maintain and guide the arm 21 along the Y axis of the imaging plate.

It will be noted that the manner in which the courser arms 19 and 21 cross one another, the corresponding slots 19A and 21A define a set for confining the courser 28. The arrangement is such that when courser arm 19 is translated or reciprocated from left to right and vice versa as viewed in FIG. 1, the courser will translate along the X axis at whatever location the courser arm 21 is located. Also, as the courser arm 21 is shifted laterally of the imaging plate, the courser 28 will shift along the Y axis at whatever located the courser arm 19 is located. By coordinating the operation of courser arm 19 and 21, the courser 28 can be guided over the surface of the opaque sheet as desired.

For an irridescent or luminescent image to appear on the imaging plate, the courser 28 must impart a pressure on the opaque sheet 23 so that at the interfaceof plate 22 and 23, intimate contact occurs therebetween wherever such pressure is applied. Where the opaque sheet contacts the imaging plate by the applied pressure of the courser, the reflection of light in such an irridescent or luminescent image is formed, e.g. as seen in FIG. 1 at 30. The image remains so long as the pressure points applied to the opaque sheet remain in intimate contact with the imaging plate 22.

Figure 7:
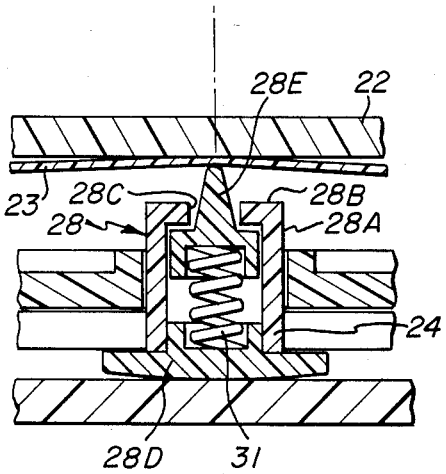
FIG. 7 is an enlarged sectional view taken on line 7—7 of FIG. 5.

In order to insure the proper application of pressure by the courser 28 as it is moved, the courser comprises a body 28A which is illustrated as generally cylindrical which is provided with an inturned flange 28B at one end to define an opening 28C. The bottom of the body 28A is closed by courser bottom plate 28D. Projecting upwardly from the courser body is a movable tip 28E which is biased toward the opaque sheet 23 by a spring member 31. The arrangement is such that the spring 31 exerts the force necessary for urging the tip 28E of the courser 28 against the opaque sheet 23 to make intimate contact with the imaging plate 22 as best seen in FIG. 7. Thus, wherever the courser 28 is moved by the operation of the courser arms 19 and 21, the courser tip 28E will pressure the opaque sheet against the imaging plate 22 to create an irridescent image at the point of contact. As long as the live contact remains between the opaque sheet 23 and imaging 22, the image will remain.

To erase the image, an erasing means is provided. As best seen in FIG. 2, the eraser means 32 comprises a handle 33 which extends across the top of the imaging plate 22. The opposed ends 33A, 33B of the handle 33 depend below the surface of the imaging plate. Extended between the opposed ends 33A, 33B of the handle 33 is a strand or filament 33C which is disposed between the lower surface of the imaging plate 22 and the opaque sheet 23. The arrangement is such that when the handle 33 of the erasing means is shifted laterally across the face of the imaging plate 22, the strand or filament will separate or break the line of contact between the opaque sheet 23 and plate 22 to erase the image.

For purposes of shipping and storage, it is desirable that the opaque sheet be maintained spaced slightly from the imaging plate 22 to maintain the imaging plate free of any markings or images. Tis is attained by providing a separating sheet 35 to be inserted between the imaging plate 22 and the opaque sheet 23. To facilitate the insertion of the separating sheet between plate 22 and sheet 23, the upper housing is provided with a slot 36 as best seen in FIG. 6. Thus, whenever play or use of the device 10 is ended, the separater sheet 35 is inserted into slot 36 so as to positively maintain the separation between the imaging plate 22 and the opaque sheet 23.

From the foregoing, it will be apparent that a readily simple and positive sketching device is provided for producing a semi-permanent irridescent or luminescent image which is amusing and challenging. The device also, when used as a toy, enables a child to enhance his or her coordination skills, in that a certain amount of coordination is required to form a desired image. The irridescent or luminescent effect also provides the image with color which is pleasing, fascinating and amusing; which greatly enhances the play value of the device. While used as a toy, the device may also have commercial applications, e.g., in advertising and/or commercial displays.

While the invention has been described with respect to a particular embodiment thereof, variations and modifications may be made without departing from the spirit or scope of the invention.

What is claimed is:

1. A sketching device for making an irridescent image comprising a housing having an upper member and a complementary lower member, said upper member having a window formed therein, a transparent imaging surface having disposed therein an irridescent dye, a sheet of opaque plastic material disposed below said imaging surface, said imaging surface and sheet of opaque material being disposed in interfacing relationship, an inner annular frame disposed between said upper and lower members in alignment with said window, means for securing said imaging surface and underlying opaque material to said inner frame, a courser disposed in contacting relationship with said sheet of opaque material for imparting a pressure thereon and actuating means for moving said courser along an X and Y axis either independently or simultaneously relative to said sheet of opaque material whereby the pressure applied by the courser as it is translated relative to said sheet develops an irridescent image at said imaging surface along the points of applied pressure, said actuating means including a pair of courser arms disposed at right angles to one another and crossing each other, each of said courser arms having elongated slot formed therein, and said courser being captive by said courser arms at the intersection thereof whereby said courser is guided along said slots as one or both of said courser arms is translated relative to said imaging sheet.

2. A sketching device as defined in claim 1 wherein said courser includes a courser body held captive by the intersecting slots if said courser arms, a courser tip projecting out from said courser and a spring for normally biasing said courser tip against said sheet of opaque material.

3. A sketching device as defined in claim 2 wherein said courser includes a bottom member connected to said body member, and said body member including an inturned flange to define an opening therein, and said courser tip projects beyond said opening.

4. A sketching device for making an irridescent image comprising a housing comprising an upper member and a lower base member, said upper member having a window opening formed therein, and a pair of elongated slots disposed normal to one another adjacent a corresponding edge of said window opening, an inner endless frame member disposed in alignment with said window opening between said upper member and said base member, a transparent imaging plate having an irridescent dye disposed therethrough, an opaque plastic sheet disposed in interfacing relationship to said imaging plate, means for securing said imaging plate and opaque sheet to said frame member whereby said imaging plate is disposed within said window opening, and said opaque sheet underlying said imaging plate, said inner frame member having a depending flange defining a guide rail extending along adjacent normally disposed edges thereof, said guide rails being disposed parallel relative to a corresponding elongated slot, a pair of courser arms crossing one another for movement along the X and Y axis of said imaging plate interposed between said inner frame member and said lower base member, each of said courser arms having an elongated slot formed therein, said slots being disposed in intersecting relationship, a courser means confined to said intersecting slots at the point of intersection, said courser means including a body portion that is retained at the intersection of said elongated, intersecting slots, each of said courser arms having an operating knob projecting upward through corresponding housing slot, a guide groove formed on each of said courser arms for receiving a corresponding depending guide rail of said inner frame member, said courser means including a body portion confined in the courser arm slots at the intersection thereof, a courser tip movably mounted in said body portion, a spring means for biasing said courser tip toward said opaque sheet, and an erasing means, said erasing means comprising a handle portion and connecting opposed depending flanges, an erasing strand extending between the opposed flanges of said handle, said erasing strand being disposed between said imaging plate and said opaque sheet whereby said strand effects separation between said imaging plate and opaque sheet at the point of contact therebetween to erase the irridescent image.

* * * * *